US005167346A

United States Patent [19]

Bodziak

[11] Patent Number: 5,167,346

[45] Date of Patent: Dec. 1, 1992

[54] DISPENSER FOR A STACK OF SHEETS

[75] Inventor: Douglas P. Bodziak, Lake Elmo, Minn.

[73] Assignee: Minnesota Mining and Manufacturing Company, St. Paul, Minn.

[21] Appl. No.: 854,255

[22] Filed: Mar. 20, 1992

[51] Int. Cl.[5] ..... B65H 1/00

[52] U.S. Cl. ..... 221/63; 221/185

[58] Field of Search ..... 221/33, 45, 46, 47, 221/63, 64, 282, 185; 206/39.6, 39.7, 39.8, 233, 215, 555

[56] References Cited

U.S. PATENT DOCUMENTS

| | | | |
|---|---|---|---|
| Re. 24,166 | 6/1956 | Stiller | 150/37 |
| 2,754,029 | 7/1956 | Maxcey, Jr. | 221/46 |
| 2,854,134 | 9/1958 | Humphrey | 221/46 |
| 3,628,691 | 12/1971 | Hillman | 221/46 X |
| 4,416,392 | 11/1983 | Smith | 221/45 |
| 4,562,938 | 1/1986 | Loder | 221/46 |
| 4,586,629 | 5/1986 | Loder | 221/46 |
| 4,586,631 | 5/1986 | Loder | 221/58 |
| 4,653,666 | 3/1987 | Mertens | 221/45 |
| 4,695,241 | 9/1987 | Ventimiglia | 425/275 |
| 4,770,320 | 9/1988 | Miles et al. | 221/33 |
| 4,800,116 | 1/1989 | Ventimiglia et al. | 428/215 |
| 4,921,127 | 5/1990 | Windorski | 221/45 |
| 4,993,590 | 2/1991 | Windorski | 221/46 |
| 5,060,794 | 10/1991 | Linn et al. | 206/232 |

OTHER PUBLICATIONS

U.S. patent application Ser. No. 07/640,617 filed Nov. 11, 1991.

*Primary Examiner*—David H. Bollinger

*Attorney, Agent, or Firm*—Gary L. Griswold; Walter N. Kirn; William L. Huebsch

[57] ABSTRACT

A dispenser for a stack of sheets disposed in a stack with each of the sheets having a band of adhesive coated on a portion of its bottom surface adjacent one edge by which the sheet is releasably adhered to the top surface, of the adjacent sheet in the stack, the sheets being stacked with the bands of adhesive of adjacent sheets at alternate opposite sides of the stack. The dispenser includes normally generally planar top wall formed by a single layer of resiliently flexible polymeric material and having two opposed portions with a slot therebetween through which the uppermost sheet in the stack can be withdrawn, whereupon the top wall portion adjacent the band of adhesive on the uppermost sheet will flex away from the stack to form a surface adjacent the stack along which the sheet being withdrawn and the end of the second uppermost sheet in the stack to which the band of adhesive on the sheet being withdrawn is adhered can slide, and the top wall portion opposite the band of adhesive on the withdrawn uppermost sheet will place drag on the second uppermost sheet in the stack so that the force applied to withdraw the uppermost sheet will peel the uppermost sheet away from the end of the second uppermost sheet in the stack after it is withdrawn through the slot rather than fully withdrawing the second sheet through the slot.

16 Claims, 3 Drawing Sheets

DISPENSER FOR A STACK OF SHEETS

TECHNICAL FIELD

The present invention relates to dispensers for sheets disposed in a stack with each of the sheets having a band of adhesive coated on one surface along one edge by which the sheets are adhered together and with the sheets being stacked with the band of adhesive of adjacent sheets at alternate opposite edges of the stack.

BACKGROUND ART

One dispenser for sheets of note paper in such a stack (i.e., "Scotch" brand "Post-it" Note Pads commercially available from Minnesota Mining and Manufacturing Co., St. Paul, Minn.) is described in U.S. Pat. No. 4,416,392 assigned to the assignee of this application, wherein the stack of sheets is disposed in a box and the sheets can be withdrawn through a slot in the top of the box and centrally disposed parallel to the opposite edges of the sheets which are coated with the bands of adhesive. The box described in U.S. Pat. No. 4,416,392, however, provides no means for preventing the second sheet in the stack from being withdrawn with the first sheet in the stack in response to force applied to the first sheet to withdraw it. Thus, to separate the first sheet from the second after the first sheet is withdrawn from the box, the first sheet must be manually peeled from the second while manually holding the second sheet, which is inconvenient.

U.S. Pat. No. 4,416,392 also describes a dispenser for such a stack of sheet material wherein a base is provided for supporting a removable cover within which is disposed the stack of sheet material. The cover is provided with an opening in its top wall and the stack of sheets is urged toward the top wall by a spring. The top wall is formed by two inclined portions which terminate at the dispensing opening. While the spring in this dispenser provides means for preventing the second sheet in the stack from being withdrawn with the first sheet in the stack in response to force applied to the first sheet to withdraw it due to the pressure the spring provides between the second sheet and the top wall, this dispenser comprises four basic parts to dispense the stack of sheets, and the sharp edges in the dispenser at the opening cause sheets that are dispensed to become stressed during the dispensing action about the edges of the opening so that the sheets retain a curl after they are dispensed.

Subsequent non commercialized attempts to provide improved dispensers from such a stack of note paper are described in U.S. Pat. Nos. 4,562,938, 4,586,629, 4,586,630, and 4,586,631 assigned to the assignee of this application.

U.S. Pat. No. 4,653,666, assigned to the assignee of this application, discloses a further embodiment of a dispenser for such a stack of sheets which has been commercialized. This dispenser comprises a box which fits about the stack of sheets and has a centrally disposed opening transverse to the edges coated with the adhesive. A spring member in the box presses the stack of sheets toward the opening. Extending from the top wall of the box and into the opening are flexible polymeric flaps which during dispensing of the sheets bend to form convex arcuate surfaces about which the sheets are drawn as they are dispensed. This structure thus avoids the development of any curl in the dispensed sheets so that the sheets, after being dispensed and positioned on a receptor lay generally flat along the surface of the receptor and thus are not as subject to becoming dislodged as they would be had a curl been present in the dispensed sheet. This dispenser, as noted however, comprises a number of parts.

U.S. Pat. No. 4,921,127 also assigned to the assignee of this application, describes refillable dispensers for such a stack of sheets comprising a base part adapted to be supported on a horizontal support surface and to support the stack of sheets; and a body part having a bottom surface including spaced pressure surface portions adapted to engage and be supported on the upper surface of the stack adjacent the edges of the sheets along which the narrow bands of adhesive are coated with the spaced pressure surface portions engaging an upper surface of the sheets at predetermined distances from the edges of the sheets along which the narrow bands of adhesive are coated, and convex arcuate surface portions between the pressure surface portions and a top surface of the body part defining a slot through and extending centrally across the body part. The convex arcuate surface portions have radii having a dimension at least as great as the predetermined distances to restrict curling of sheets of paper pulled from the dispenser through the slot, and the body part has sufficient weight (e.g., about 0.5 to 1.5 pound) to afford pulling a sheet from the stack through the slot without substantially lifting the body part from the stack.

U.S. Pat. No. 4,993,590 also assigned to the assignee of this application, describes a refillable dispenser for such a stack of sheets adapted to be attached to a surface and having a top wall including spaced pressure surface portions adapted to engage the upper surface of the stack at predetermined distances from the edges of the sheets along which the narrow bands of adhesive are coated to define a slot through and extending centrally across the body part through which the sheets are withdrawn, which dispenser arcs the stack to facilitate withdrawal of the sheet, and includes means for pressing the stack against its top wall.

A dispenser for polymeric sheets in such a stack (i.e., "Post-it" brand Tape Flags commercially available from Minnesota Mining and Manufacturing Co., St. Paul, Minn.) is described in U.S. Pat. No. 4,770,320 assigned to the assignee of this application, wherein the stack of sheets is disposed in a dispenser and the sheets can be withdrawn through a slot in the top of the dispenser that is centrally disposed parallel to the opposite edges of the sheets which are coated with the bands of adhesive. The dispenser described in U.S. Pat. No. 4,770,320 provides shuttling of the stack of sheets back and forth in the dispenser to preventing the second sheet in the stack from being withdrawn with the first sheet in the stack in response to force applied to the first sheet to withdraw it.

While several of the dispensers described in the U.S. Patents described above are effective in allowing sheets to be withdrawn from the stack without either curling or wrinkling the sheets and without withdrawing the second sheet in the stack with the sheet being withdrawn, there is an ongoing effort to provide develop new dispensers for sheets from such a stack.

DISCLOSURE OF INVENTION

The present invention provides dispensers for stacks of sheets of both types mentioned above (i.e., either "Scotch" brand "Post-it" Note Pads or "Post-it" brand Tape Flags) that is refillable, inexpensive, and effective in allowing sheets to be withdrawn from the stack without either curling or wrinkling the sheets, and without withdrawing the second sheet in the stack with the sheet being withdrawn.

According to the present invention there is provided a dispenser for a stack of similarly sized sheets disposed in alignment in the stack with each of the sheets having top and bottom surfaces and a band of adhesive coated on a portion of bottom surface adjacent one edge by which the sheet is releasably adhered to the top surface of the adjacent sheet in the stack. The sheets are stacked with the bands of adhesive of adjacent sheets at alternate opposite sides of the stack, and the stack has first side surfaces at the alternate opposite sides of the stack, has second side surfaces disposed in a direction at a right angle to the first side surfaces, and has a top surface defined by the top surface of the uppermost sheet in the stack. The dispenser comprises a housing comprising walls having inner surfaces defining a cavity in which the stack of sheets is positioned. The walls include a top wall formed by a normally generally planar single layer of resiliently flexible polymeric material positioned adjacent the top surface of the stack. The top wall has edge surfaces parallel to the first side surfaces of the stack, which edge surfaces define two opposed portions of the top wall and a slot through the top wall between the two opposed portions through which slot projects a portion of the uppermost sheet in the stack. When the uppermost sheet in the stack is withdrawn through that slot, the opposed portion of the top wall adjacent the band of adhesive on the uppermost sheet will flex away from the stack to form a surface adjacent the stack along which the sheet being withdrawn and the end of the second uppermost sheet in the stack to which the band of adhesive is adhered can slide to thereby restrict curling of the sheets, and the flap like portion opposite the band of adhesive on the withdrawn uppermost sheet will place drag on the second uppermost sheet in the stack so that the force applied to withdraw the uppermost sheet will peel the uppermost sheet away from the end of the second uppermost sheet in the stack after it is withdrawn through the slot rather than fully withdrawing the second sheet through the slot.

While the housing of the dispenser could be molded in different ways and from different materials, preferably, it is dip molded and is formed of plasticized polyvinyl chloride having a Shore hardness in the range of about 40 to 80 which provides desirable frictional characteristics with sheets being withdrawn from the dispenser so that the sheet will be dispensed in the manner described above.

In one embodiment adapted for dispensing elongate sheets of polymeric material in such a stack (e.g., "Post-it" brand Tape Flags of the type described in U.S. Pat. No. 4,770,320, the content whereof is incorporated herein by reference) the dispenser is the dip molded structure described in U.S. Pat. No. RE 24,166 (the content whereof is incorporated herein by reference) which dip molded structure has long been used for a coin purse. In that embodiment, all of the walls of the dispenser are of resiliently flexible polymeric material, and the dispenser further includes a generally planar rear wall normally generally parallel to and spaced from the top wall, and side walls extending between the peripheries of the rear wall and the top wall, the top and bottom walls having generally oval peripheries with the edge surfaces extending longitudinally of and bisecting the top wall. The edge surfaces are then separable by manually pressing the side walls adjacent the ends of edge surfaces toward each other to afford positioning the stack of sheets to be dispensed in the cavity.

In another embodiment adapted for dispensing paper sheets in such a stack (e.g., "Scotch" brand "Post-it" Notes), the top wall has through parallel flanking slits flanking the edge surfaces of the top wall so that the opposed portions of the top wall are flap like with the slot through the top wall being between the flap like portions, and the edge surfaces on the opposed flap like portions of the top wall are spaced from each other. In that embodiment, the dispenser can further include a generally planar rear wall normally generally parallel to and spaced from the top wall, and side walls extending between the peripheries of the rear wall and the top wall, with the top and bottom and side walls being integrally molded of the resiliently flexible polymeric material, and with the rear wall having a through opening. That embodiment of the dispenser can further include base means including an interlocking portion adapted, by resilient flexing of the walls, to be inserted through the opening and to engage the inner surface of the rear wall around the opening to retain the base means in releasable engagement with the walls, and a mounting portion adapted for supporting the dispenser on or attaching the dispenser to a predetermined type of structure (e.g., a weighted base for supporting the dispenser on a desk top, or a hook like portion for attaching the dispenser to a sun visor of an automobile). The interlocking portion is removable from the walls to afford positioning a stack of sheets to be dispensed into the cavity through the opening in the rear wall.

BRIEF DESCRIPTION OF DRAWING

The present invention will be further described with reference to the accompanying drawing wherein like reference numerals refer to like parts in the several views, and wherein.

DETAILED DESCRIPTION

Figure 1:
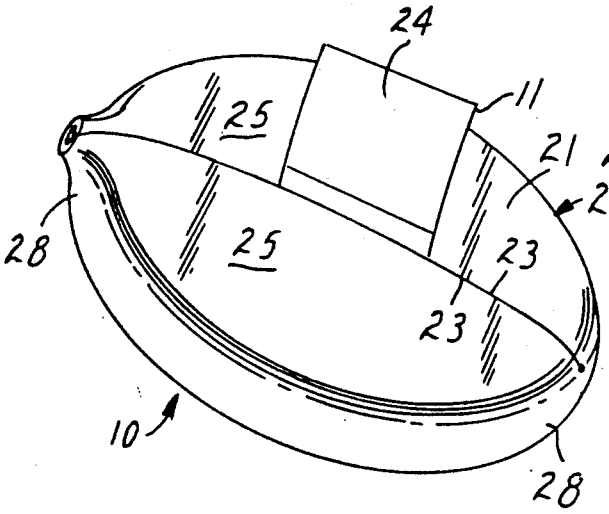
FIG. 1 is a perspective view of a first embodiment of a combination of a stack of sheets and a dispenser according to the present invention.

Referring now to FIGS. 1 through 4 of the drawing, there is illustrated a first embodiment of a combination 10 according to the present invention of (1) a stack 12 of similarly sized sheets 11 of polymeric material (e.g., a stack of "Post-it" brand Tape Flags commercially available in a different dispenser from Minnesota Mining and Manufacturing Co., St. Paul, Minn., which are described in U.S. Pat. No. 4,770,320 assigned to the assignee of this application, the content whereof is hereby incorporated herein by reference), and a dispenser comprising a housing 20 which has essentially the same structure as the "self closing container" often used as a coin purse that is described in U.S. Pat. No. Re. 24,166. The sheets 11 are disposed in alignment in the stack 12 with each of the sheets 11 having top and bottom surfaces and a band of adhesive coated on a major portion of the bottom surface along one edge by which the sheet 11 is adhered to the top surface of the adjacent sheet 11 in the stack 12. The sheets 11 are stacked with the bands of adhesive of adjacent sheets 11 at alternate opposite sides of the stack 12, with the stack 12 having first side surfaces 16 at the alternate opposite sides of the stack 12, having second side surfaces 18 disposed in a direction at a right angle to the first side surfaces 16, having a top surface 19 defined by the top surfaces of the uppermost sheets 11 in the stack 12, and having an opposite bottom surface. The housing 20 comprises walls having inner surfaces defining a cavity 17 in which the stack 12 of sheets 11 is positioned. The walls include a top wall 21 which is a normally generally planar single layer of resiliently flexible polymeric material positioned adjacent the top surface 19 of the stack 12. The top wall 21 has edge surfaces 23 parallel to the first side surfaces 16 of the stack 12, which edge surfaces 23 define two opposed portions 25 of the top wall 21 and a slot through the top wall 21 between the two top wall portions 25 through which slot projects a brightly colored adhesive free end portion 24 of the uppermost sheet 11 in the stack 12 so that when the uppermost sheet 11 in the stack 12 is withdrawn through the slot, the top wall portion 25 adjacent the band of adhesive on the uppermost sheet 11 in the stack 12 will flex away from the stack 12 (see FIG. 4) to form a surface adjacent the stack 12 along which the sheet 11 being withdrawn and the end of the second uppermost sheet 11 in the stack 12 to which the band of adhesive is adhered can slide to thereby restrict curling of the sheets 11, and the top wall portion 25 opposite the band of adhesive on the withdrawn uppermost sheet 11 will place drag on the second uppermost sheet 11 in the stack 12 so that the force applied to withdraw the uppermost sheet 11 will peel the uppermost sheet 11 away from the end of the second uppermost sheet 11 in the stack 12 after it is withdrawn through the slot rather than fully withdrawing the second sheet 11 through the slot.

Figure 5:
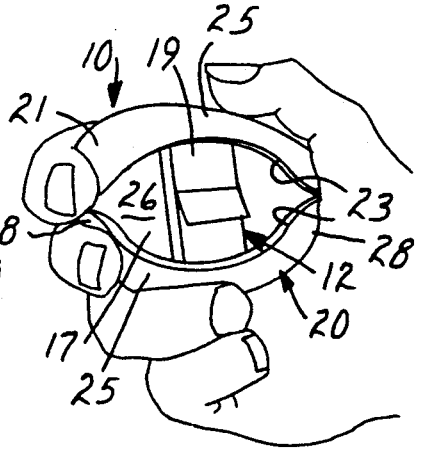
FIG. 5 is a perspective view of the dispenser of FIG. 1 being opened to afford inserting a stack of sheets.
Figure 2:
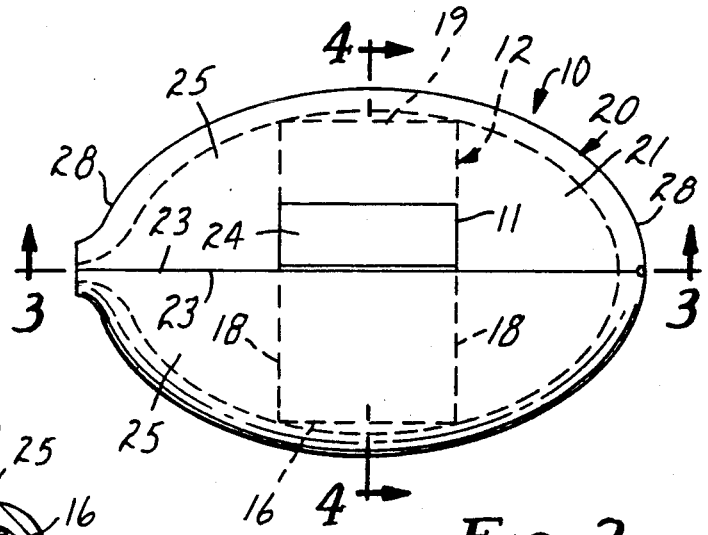
FIG. 2 is a top view of the combination of FIG. 1.
Figure 4:
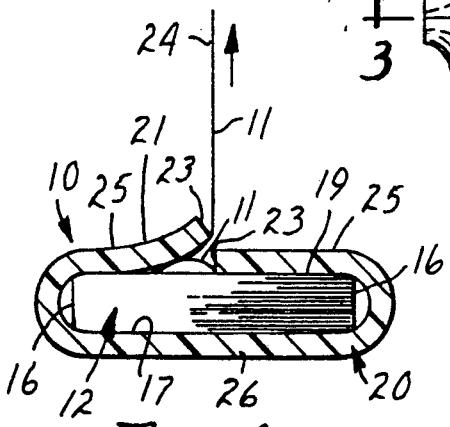
FIG. 4 is a sectional view taken approximately along line 4—4 of FIG. 2 in which a sheet is being withdrawn from the dispenser.
Figure 3:
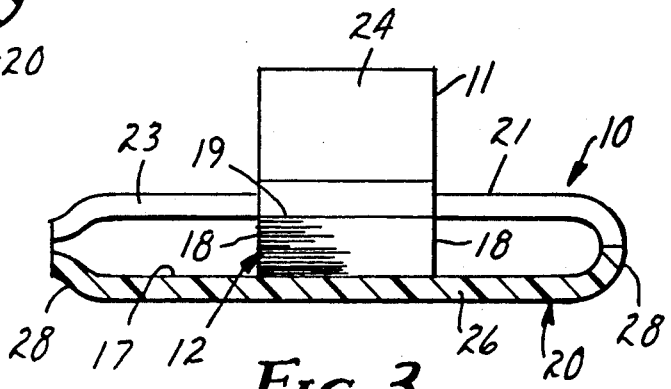
FIG. 3 is a sectional view taken approximately along line 3—3 of FIG. 2.
Figure 6:
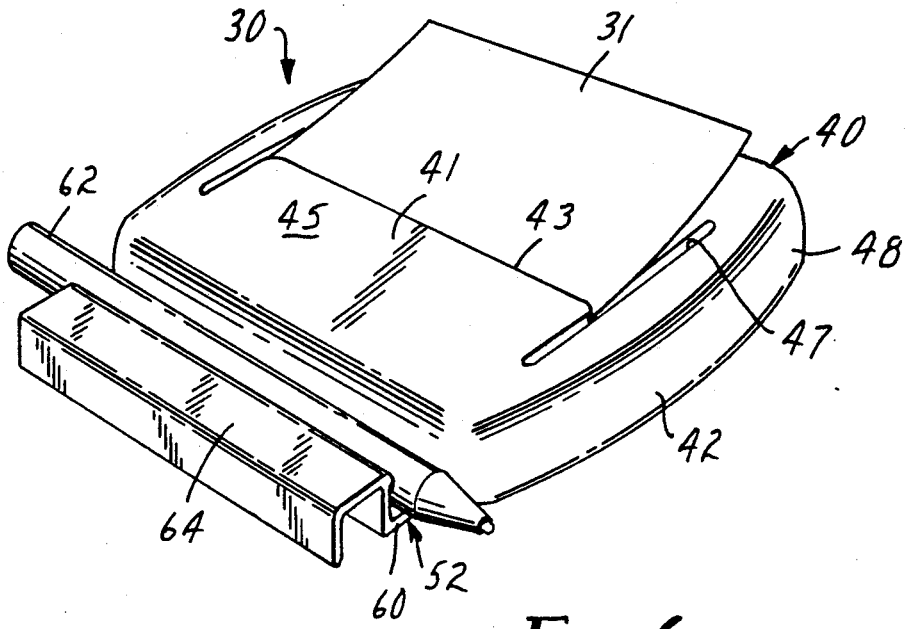
FIG. 6 is a perspective view of a second embodiment of a combination of a stack of sheets and a dispenser according to the present invention.
Figure 7:
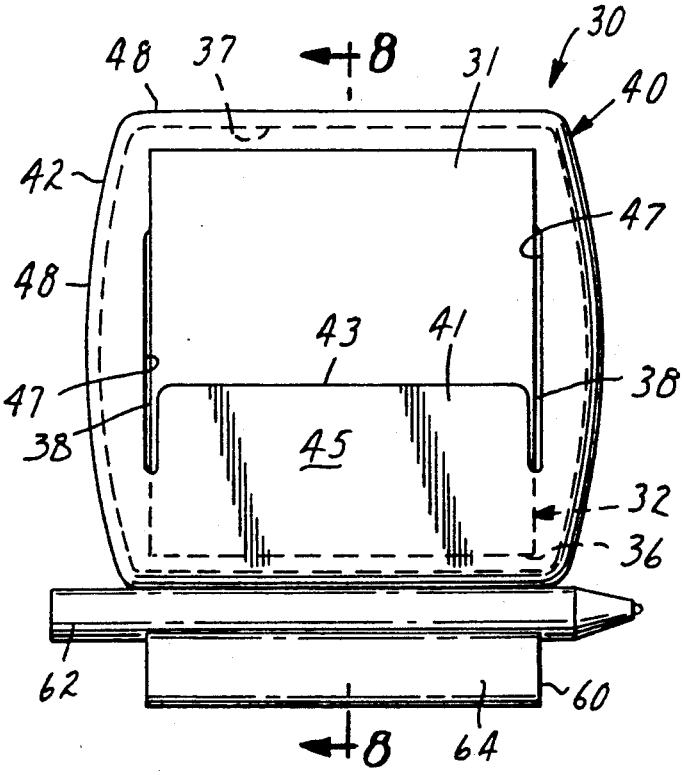
FIG. 7 is a top view of the combination of FIG. 6.
Figure 8:
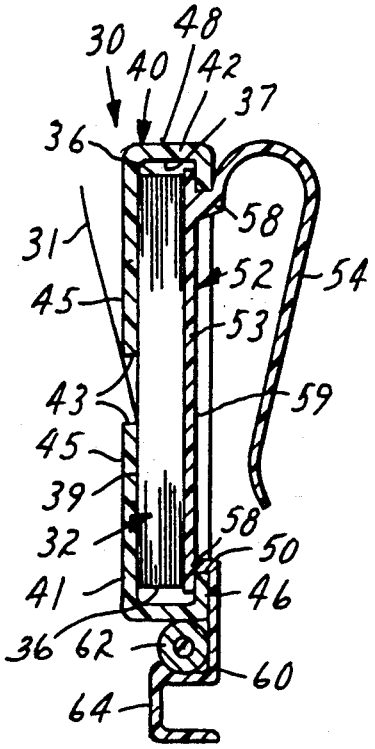
FIG. 8 is a sectional view taken approximately along line 8—8 of FIG. 7.
Figure 10:
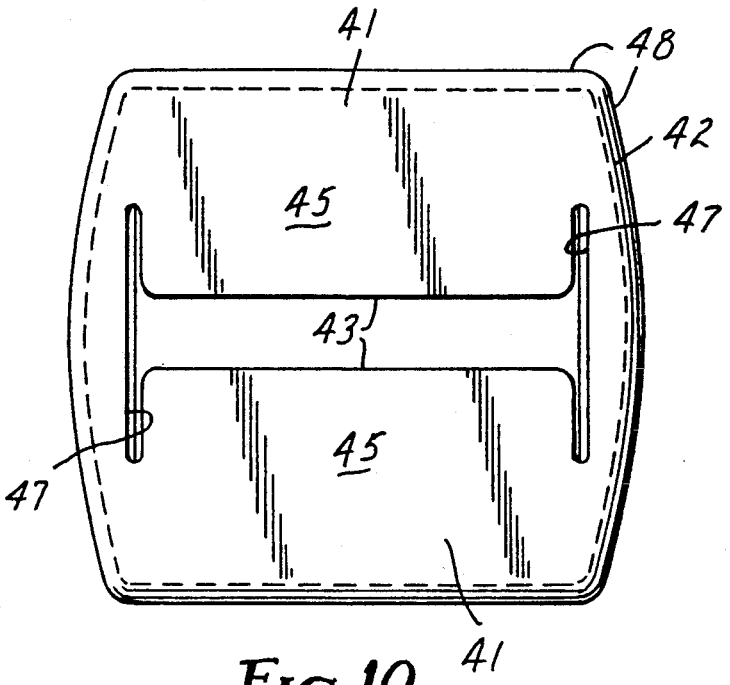
FIG. 10 is a front view of a housing portion of the dispenser with the stack of sheets and a base member removed.
Figure 9:
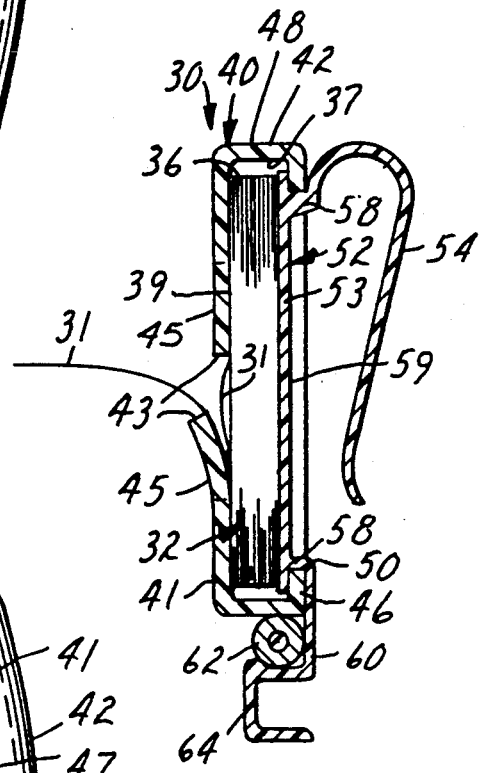
FIG. 9 is a sectional view taken approximately along line 8—8 of FIG. 7 illustrating a sheet being withdrawn from the dispenser.
Figure 11:
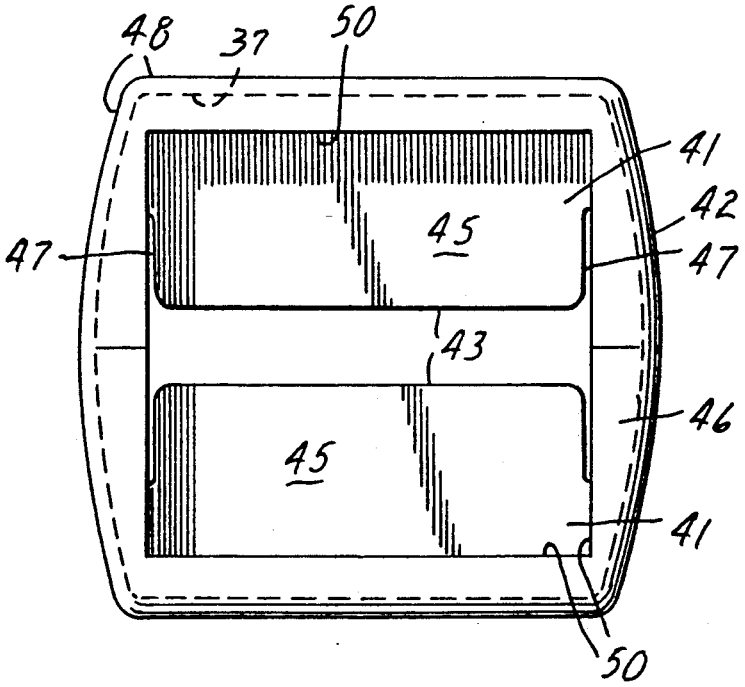
FIG. 11 is a rear view of the housing portion of the dispenser shown in FIG. 10.

All of the walls of the dispenser are integrally dip molded of resiliently flexible polymeric material, and the dispenser 20 further includes a generally planar bottom or rear wall 26 normally generally parallel to and spaced from the top wall 21, and side walls 28 extending between the peripheries of the bottom wall 26 and the top wall 21. The top and bottom walls 21 and 26 have generally oval peripheries, and the edge surfaces 23 extend longitudinally of and bisect the top wall 21. As is illustrated in FIG. 5, the edge surfaces 23 are separable by manually pressing the side walls 28 adjacent the ends of edge surfaces 23 toward each other to afford positioning the stack 12 of sheets 11 to be dispensed in the cavity 17.

Referring now to FIGS. 6 through 11 of the drawing, there is illustrated a second embodiment of a combination 30 according to the present invention of (1) a stack 32 of similarly sized sheets 31 of paper material (e.g., a stack 32 of "Scotch" brand "Post-it" Notes or sheets 31 each 7 centimeter by 7.6 centimeter (2.75 inch by 3 inch) although many other sizes could also be used) and a dispenser 40. The sheets 31 are disposed in alignment in the stack 32 with each of the sheets 31 having top and bottom surfaces and a narrow band of adhesive coated on the bottom surface along one edge by which the sheet 31 is adhered to the top surface of the adjacent sheet 31 in the stack 32. The sheets 31 are stacked with the bands of adhesive of adjacent sheets 31 at alternate opposite sides of the stack 32, the stack 32 having first side surfaces 36 at the alternate opposite sides of the stack 32, having second side surfaces 38 disposed in a direction at a right angle to the first side surfaces 36, having a top surface 39 defined by the top surface of the uppermost sheet 31 in the stack 32, and an opposite bottom surface.

The dispenser 40 includes a housing 42 comprising walls having inner surfaces defining a cavity 37 adapted for receiving a the stack 32 of sheets. Those walls include a top wall 41 consisting of a normally generally planar single layer of resiliently flexible polymeric material adapted to be positioned adjacent the top surface 39 of the stack 32. The top wall 41 has through parallel flanking slits 47 adapted to be parallel to and to flank the second side surfaces 38 of the stack 32 and to be generally centered between the first side surfaces 36 of the stack 32. Also, the top wall 41 has spaced edge surfaces 43 extending between the flanking slits 47. The flanking slits 47 and edge surfaces 43 define two opposed flap like portions 45 of the top wall 41 and a slot through the top wall 41 between the two opposed flap like top wall portions 45 through which slot can project a portion of the uppermost sheet 31 in the stack 32 when the stack 32 is positioned in the cavity 37 so that when the uppermost sheet 31 in the stack 32 is withdrawn through the slot the top wall portion 45 adjacent the band of adhesive on the uppermost sheet 31 will flex away from the stack 32 to form an arcuate surface adjacent the stack 32 along which the sheet 31 being withdrawn and the end of the second uppermost sheet 31 in the stack 32 to which the band of adhesive is adhered can slide to thereby restrict curling of the sheets 31, and the flap like top wall portion 45 opposite the band of adhesive on the withdrawn uppermost sheet 31 will place drag on the second uppermost sheet 31 in the stack 32 so that the force applied to withdraw the uppermost sheet 31 will peel the uppermost sheet 31 away from the end of the second uppermost sheet 31 in the stack 32 after it is withdrawn through the slot rather than fully withdrawing that second sheet 31 through the slot.

The walls of the housing 42 further include a generally planar and generally rectangular bottom or rear wall 46 normally generally parallel to and spaced from the top wall 41, and side walls 48 extending between the peripheries of the rear wall 46 and the top wall 41. The top, rear and side walls 41, 46, and 48 are integrally molded of resiliently flexible polymeric material (i.e., plasticized vinyl compound, or more specifically, a dip molded plasticized polyvinyl chloride having a Shore hardness in the range of about 40 to 80), with the walls having a thickness (i.e., the range of about 1/16 to ⅛ inch) that causes them to retain their shape while being sufficiently flexible that the flap like top wall portions 45 will flex to afford dispensing of sheets 41 in the manner described above. For use with a stack 32 of "Scotch" brand "Post-it" Notes each 7 centimeter by 7.6 centimeter (2.75 inch by 3 inch), the adhesive being along the narrower edges) the slits 47 should be in the range of about 0.187 inch to 3.25 inch long and are preferably about 1.75 inches long end to end and 3/32 inch wide adjacent their ends. The slits 47 are spaced apart by at least the width of the stack 32. The edge surfaces 43 should be spaced apart in the range of about 0.187 to 2 inches, and are preferably spaced by about 0.437 inch, and the top wall 41 is preferably in the range of about 0.062 to 0.125 inch thick. Also, for 100 sheet stacks 32, preferably the top and rear walls 41 and 46 are spaced to fairly closely fit the thickness of the stack 32.

The rear wall has 46 a through opening 50 with a generally rectangular periphery, and the dispenser 40 further includes a base means or base member 52 including an interlocking portion 53 adapted, by resilient flexing of the walls 41, 46 and 48, to be at least partially inserted through the opening and to engage the inner surface of the rear wall 46 around the opening 50 to retain the base member 52 in releasable engagement with the rear wall 46, and a mounting portion 54 adapted for supporting the dispenser 40 on or attaching the dispenser 40 to a predetermined type of structure. As illustrated, the mounting portion 54 is hook like and is adapted for attaching the dispenser 40 to a sun visor of an automobile, however, alternatively it could be in any other desired form, including in the forms of suction cups or a magnet for attaching the dispenser 40 to a surface, or in the form of a weighted base for supporting the dispenser 40 on a desk top.

As illustrated, the base member 52 is an extrusion of a stiff resiliently flexible polymeric material having opposed outwardly opening U-shaped channel parts 58 defining recesses adapted to receive opposite portions of the rear wall 46, a central planar part 59 extending between the channel parts 58, and the hook like mounting portion 54 attached at one end to the central part 59. As illustrated the base member 52 can also include a second hook like part 60 adapted to project below the bottom of the housing 42 that defines a channel with a forward facing opening adapted to releasably engage a pen or pencil 62 accessible from the front of the dispenser 40, which hook like part 60 can have a planar front surface portion 64 on which decoration, messages, advertising or the like can be printed, and on which the adhesive layer of a sheet 31 from the stack 32 can be releasably attached.

The interlocking portion 53 is removable from the rear wall 46 through the opening 50 in the rear wall 46 by resilient flexing of the walls 41, 46 and 48 to afford positioning the stack 32 of sheets 31 to be dispensed into the cavity 37 through the opening 50 in the rear wall 46, after which the interlocking portion 53 can again be engaged with the rear wall 46.

The dispenser 20 and the housing 42 can be made by the known process of dip molding described in U.S. Pat. Nos. 4,800,116 and 4,695,211 generally includes the process of making a mold having the shape of a cavity to be formed in the part to be molded, dipping the mold into silicone oil, heating the oiled mold, dipping the heated oiled mod into a bath containing a liquid plastisol that will cure upon heating so that the liquid plastisol begins to cure on the surface of the heated mold, retaining the heated mold in the bath for a time calculated to partially cure and thereby attach a predetermined thickness of the heat curable plastisol to the mold, removing the mold from the liquid plastisol bath, heating the plastisol covering the mold to cure the outer portion of the plastisol, quenching the mold and part to cool the cured plastisol and stop the curing process, cutting the part sufficiently to afford its removal from the mold, and then trimming and cutting portions from the molded part as needed. The dispenser 20 need only be cut to form its edge surfaces 23 to afford its removal from the mold. The housing 42 can be cut across its rear wall to afford its removal and then trimmed to form the opening 50 and flap like portions 45. It is contemplated that, alternatively, the housing 42 can be cut against the mold to form the opening 50 and flap like portions 45 before it is removed from around the mold.

Either the dispenser 20 or the housing 42 can be printed with various printing techniques (e.g., silk screen, pad transfer printing, ink jet printing or laser marking) to form decorative patterns, logos, or messages (e.g., advertising massages).

The present invention has now been described with reference to two embodiments and several variations thereof. It will be apparent to those skilled in the art that many changes can be made in the embodiments described without departing from the scope of the present invention. Thus the scope of the present invention should not be limited to the structures described in this application, but only by structures described by the language of the claims and the equivalents of those structures.

I claim:

1. In combination, a stack of similarly sized sheets disposed in alignment in the stack with each of the sheets having top and bottom surfaces and a band of adhesive coated on a portion of said bottom surface adjacent one edge by which the sheet is releasably adhered to the top surface of the adjacent sheet in the stack, the sheets being stacked with the bands of adhesive of adjacent sheets at alternate opposite sides of the stack, said stack having first side surfaces at said alternate opposite sides of the stack, having second side surfaces disposed in a direction at a right angle to said first side surfaces, and a top surface defined by the top surface of the uppermost sheet in the stack; and a dispenser comprising a housing comprising walls having inner surfaces defining a cavity in which said stack of sheets is positioned, said walls including a normally generally planar top wall formed by a single layer of resiliently flexible polymeric material positioned adjacent the top surface of the stack, said top wall having edge surfaces parallel to the first side surfaces of the stack, said edge surfaces defining two opposed portions of said top wall and a slot through the top wall between the two opposed top wall portions through which slot projects a portion of the uppermost sheet in the stack so that when the uppermost sheet in the stack is withdrawn through the slot the top wall portion adjacent the band of adhesive on the uppermost sheet will flex away from the stack to form a surface adjacent the stack along which the sheet being withdrawn and the end of the second uppermost sheet in the stack to which the band of adhesive on the sheet being withdrawn is adhered can slide to thereby restrict curling of the sheets, and the top wall portion opposite the band of adhesive on the withdrawn uppermost sheet will place drag on the second uppermost sheet in the stack so that the force applied to withdraw the uppermost sheet will peel the uppermost sheet away from the end of the second uppermost sheet in the stack after it is withdrawn through the slot rather than fully withdrawing the second sheet through the slot.

2. A combination according to claim 1 wherein said resiliently flexible polymeric material is a plasticized vinyl compound having a Shore hardness generally in the range of about 35 to 100, and said top wall has a thickness in the range of about 1/16 to ⅛ inch.

3. A combination according to claim 1 wherein said resiliently flexible polymeric material is dip molded plasticized polyvinyl chloride having a Shore hardness in the range of about 40 to 80, and said top wall has a thickness in the range of about 1/16 to ⅛ inch.

4. A combination according to claim 1 wherein said top wall has through parallel flanking slits flanking said edge surfaces and said second side surfaces of said stack so that said opposed top wall portions are flap like with said slot through said top wall being between said flap like top wall portions, and said edge surfaces on said opposed flap like top wall portions are spaced from each other by a dimension in the range of about 3/16 to 2 inches.

5. A combination according to claim 4 wherein said through flanking slits defining each of said flaps like portions are in the range of 3/16 to 3.25 inches long.

6. A combination according to claim 1 wherein all of the walls of said dispenser are of resiliently flexible polymeric material, and said dispenser further includes a generally planar bottom wall normally generally parallel to and spaced from said top wall, and side walls extending between the peripheries of said bottom wall and said top wall, said top and bottom walls having generally oval peripheries with said edge surfaces extending longitudinally of and bisecting said top wall, said edge surfaces being separable by manually pressing said side walls adjacent the ends of edge surfaces toward each other to afford positioning said stack of sheets to be dispensed in said cavity.

7. A combination according to claim 1 wherein said dispenser further includes a generally planar rear wall normally generally parallel to and spaced from said top wall, and side walls extending between the peripheries of said rear wall and said top wall, said top and rear and side walls being integrally molded of resiliently flexible polymeric material, said rear wall having a through opening, and said dispenser further includes base means including a mounting portion adapted for supporting said dispenser on or attaching said dispenser to a predetermined type of structure and including an interlocking portion adapted, by resilient flexing of said walls, to be inserted through said opening and to engage said rear wall around said opening to retain said base means in releasable engagement with said walls, said interlocking portion being removable from said walls to afford positioning said stack of sheets to be dispensed into said cavity through said opening in said rear wall.

8. A combination according to claim 7 wherein said top wall has through parallel flanking slits flanking said edge surfaces and said second side surfaces of said stack so that said opposed portions of said top wall are flap like with said slot through said top wall being between said flap like portions.

9. A dispenser according to claim 1 wherein said resiliently flexible polymeric material is dip molded plasticized polyvinyl chloride having a Shore hardness in the range of about 40 to 80, and said top wall has a thickness in the range of about 1/16 to ⅛ inch.

10. A dispenser adapted for dispensing sheets from a stack of similarly sized sheets disposed in alignment in the stack with each of the sheets having top and bottom surfaces and a band of adhesive coated on a portion of said bottom surface adjacent one edge by which the sheet is releasably adhered to the top surface of the adjacent sheet in the stack, the sheets being stacked with the bands of adhesive of adjacent sheets at alternate opposite sides of the stack, said stack having first side surfaces at said alternate opposite sides of the stack, having second side surfaces disposed in a direction at a right angle to said first side surfaces, a top surface defined by the top surface of the uppermost sheet in the stack, and an opposite bottom surface;

said dispenser comprising a housing comprising walls having inner surfaces defining a cavity adapted for receiving a said stack of sheets, said walls including a top wall formed by a normally generally planar single layer of resiliently flexible polymeric material adapted to be positioned adjacent the top surface of the stack, said top wall having through parallel flanking slits adapted to be parallel to and to flank said second side surfaces of the stack and to be generally centered between the first side surfaces of the stack, and said single layer having spaced edge surfaces extending between said flanking slits, said flanking slits and edge surfaces defining two opposed flap like portions of said top wall and a slot through the top wall between said two opposed flap like top wall portions through which slot can project a portion of the uppermost sheet in the stack when the stack is positioned in the cavity so that when the uppermost sheet in the stack is withdrawn through the slot the flap like top wall portion adjacent the band of adhesive on the uppermost sheet will flex away from the stack to form a surface adjacent the stack along which the sheet being withdrawn and the end of the second uppermost sheet in the stack to which the band of adhesive on the sheet being withdrawn is adhered can slide to thereby restrict curling of the sheets, and the flap like portion opposite the band of adhesive on the withdrawn uppermost sheet will place drag on the second uppermost sheet in the stack so that the force applied to withdraw the uppermost sheet will peel the uppermost sheet away from the end of the second uppermost sheet in the stack after it is withdrawn through the slot rather than fully withdrawing the second sheet through the slot.

11. A dispenser according to claim 10 wherein said resiliently flexible polymeric material is a plasticized vinyl compound having a Shore hardness generally in the range of about 35 to 100, and said top wall has a thickness in the range of about 1/16 to ⅛ inch.

12. A dispenser according to claim 10 wherein said resiliently flexible polymeric material is dip molded plasticized polyvinyl chloride having a Shore hardness in the range of about 40 to 80, with said top wall having a thickness in the range of about 1/16 to ⅛ inch.

13. A dispenser according to claim 10 wherein said dispenser further includes a generally planar rear wall normally generally parallel to and spaced from said top wall, and side walls extending between the peripheries of said rear wall and said top wall, said top and rear and side walls being integrally molded of resiliently flexible polymeric material and said rear wall having a through opening, and said dispenser further includes base means including a mounting portion adapted for supporting said dispenser on or attaching said dispenser to a predetermined type of structure and including an interlocking portion adapted, by resilient flexing of said walls, to be inserted through said opening and to engage said rear wall around said opening to retain said base means in releasable engagement with said walls, said interlocking portion being removable from said walls to afford positioning a said stack of sheets to be dispensed into said cavity through said opening in said rear wall.

14. A dispenser according to claim 13 wherein said top wall has through parallel flanking slits flanking said edge surfaces so that said opposed portions of said top wall are flap like with said slot through said top wall being between said flap like portions.

15. A dispenser adapted for dispensing sheets from a stack of similarly sized sheets disposed in alignment in the stack with each of the sheets having top and bottom surfaces and a band of adhesive coated on a portion of said bottom surface adjacent one edge by which the sheet is releasably adhered to the top surface of the adjacent sheet in the stack, the sheets being stacked with the bands of adhesive of adjacent sheets at alternate opposite sides of the stack, said stack having first side surfaces at said alternate opposite sides of the stack, having second side surfaces disposed in a direction at a right angle to said first side surfaces, and a top surface defined by the top surface of the uppermost sheet in the stack said dispenser comprising a housing comprising walls having inner surfaces defining a cavity adapted for receiving a said stack of sheets, said walls including a top wall formed by a normally generally planar single layer of resiliently flexible polymeric material adapted to be positioned adjacent the top surface of the stack, said top wall having edge surfaces defining two opposed portions of said top wall and a slot through the top wall between said two opposed top wall portions through which slot can project a portion of the uppermost sheet in the stack when the stack is positioned in the cavity with the first surface of the stack parallel to the slot so that when the uppermost sheet in the stack is withdrawn through the slot the top wall portion adjacent the band of adhesive on the uppermost sheet will flex away from the stack to form a surface adjacent the stack along which the sheet being withdrawn and the end of the second uppermost sheet in the stack to which the band of adhesive on the sheet being withdrawn is adhered can slide to thereby restrict curling of the sheets, and the top wall portion opposite the band of adhesive on the withdrawn uppermost sheet will place drag on the second uppermost sheet in the stack so that the force applied to withdraw the uppermost sheet will peel the uppermost sheet away from the end of the second uppermost sheet in the stack after it is withdrawn through the slot rather than fully withdrawing the second sheet through the slot, said walls further including a generally planar rear wall normally generally parallel to and spaced from said top wall, and side walls extending between the peripheries of said rear wall and said top wall, said top and rear and side walls being integrally molded of resiliently flexible polymeric material, said rear wall having a through opening, and said dispenser further includes base means including a support portion adapted for supporting said dispenser on or attaching said dispenser to a predetermined type of structure and having an interlocking portion adapted, by resilient flexing of said walls, to be inserted through said opening and to engage said rear wall around said opening to retain said base means in releasable engagement with said walls, said interlocking portion being removable from said walls to afford positioning a said stack of sheets to be dispensed into said cavity through said opening in said rear wall.

16. A dispenser according to claim 15 wherein said resiliently flexible polymeric material is a plasticized vinyl compound having a Shore hardness generally in the range of about 35 to 100, and said top wall has a thickness in the range of about 1/16 to ⅛ inch.

* * * * *